United States Patent [19]

Williams

[11] 4,227,369

[45] Oct. 14, 1980

[54] CONTROL SYSTEMS FOR APPARATUS

[75] Inventor: Peter J. Williams, Bristol, England

[73] Assignee: Rolls-Royce Limited, Bristol, England

[21] Appl. No.: 901,805

[22] Filed: May 1, 1978

[30] Foreign Application Priority Data

May 13, 1977 [GB] United Kingdom ..... 20323/77

[51] Int. Cl.[3] ..... F02C 9/28

[52] U.S. Cl. ..... 60/734; 73/355 R

[58] Field of Search ..... 60/39.28 R, 39.28; 73/351, 355 R, 355 EM; 356/45

[56] References Cited

U.S. PATENT DOCUMENTS

| | | | |
|---|---|---|---|
| 3,584,509 | 6/1971 | Compton et al. | 73/355 R |
| 3,623,368 | 11/1971 | Decker | 73/355 R |
| 3,696,678 | 10/1972 | Mossey | 73/355 R |
| 3,715,922 | 2/1973 | Menge | 73/355 EM |
| 3,899,878 | 8/1975 | Compton et al. | 73/355 R |
| 3,911,435 | 10/1975 | Mardon et al. | 73/355 R |
| 3,992,943 | 11/1976 | Schiefer et al. | 73/355 R |
| 4,037,473 | 7/1977 | Compton et al. | 73/355 R |

FOREIGN PATENT DOCUMENTS

| | | |
|---|---|---|
| 472146 | 9/1937 | United Kingdom . |
| 1387060 | 3/1975 | United Kingdom . |
| 1447972 | 9/1976 | United Kingdom . |

*Primary Examiner*—Louis J. Casaregola

*Attorney, Agent, or Firm*—Stevens, Davis, Miller & Mosher

[57] ABSTRACT

Infra-red radiation detectors are used in gas turbine engines to detect radiation produced by the turbine blades giving an indication of blade temperature. Above a given limit the signal produced by the detector is passed to the fuel control system to shut down the fuel supply to the engine. An additional detector is provided which receives the same image as the first detector but is biased to detect radiation in the visible light part of the spectrum. When incandescent particles pass through the field of vision of the detectors both show an increase in signal due to both types of radiation being increased during this transient event. The signal from the second detector is used to reduce the signal from the first detector by an amount sufficient to prevent the fuel supply being temporarily shut down.

3 Claims, 2 Drawing Figures

CONTROL SYSTEMS FOR APPARATUS

This invention relates to improvements in control systems for apparatus and has particular reference to a fuel flow regulating device for a gas turbine engine.

It is known in the gas turbine engine art to provide a radiation detector for detecting radiation characteristics of the operating temperature of a part, such as a turbine blade, and to generate a signal to regulate or limit the fuel flow in the sense of controlling the temperature of the part.

In such a system we have found that hot carbon particles of either a discrete nature, or in the form of a diffuse cloud, occasionally cross the field of view of the detector. The high temperature of these particles means that they generate a large infra-red signal which adds to the signal from the turbine blade and causes the control system to react to an apparent turbine blade temperature which is higher than is actually the case. This results in the unnecessary reduction of the fuel flow.

This problem is particularly severe with certain high performance engines during acceleration and when running at maximum power, and is manifest by an intermittent limitation of the fuel flow and accompanying reduced performance of the engine. Similar situations can exist with furnaces, and other apparatus in which a parameter is observed by a radiation detector for control purposes and occasional transient events occuring during use of the apparatus generate false information about the parameter concerned.

The present invention seeks to provide a control system capable of distinguishing between actual variation of the parameter concerned and the observed value prevailing due to the occurrence of the transient event.

According to the present invention there is provided a control system for apparatus comprising a first detector responsive to radiation in a first frequency range received from the apparatus to generate as output a control signal representative of an operating characteristic of the apparatus, a second detector responsive to radiation in a second frequency range to generate a second output signal characteristic of a transient event occurring during use of the apparatus, which event is also detected by the first detector, and means responsive to the generation of the second output signal to modify the first output signal at least for the duration of the event.

Preferably the first detector is responsive to electromagnetic radiation in the infra-red frequency range and the second detector is responsive to electro-magnetic radiation in the visible frequency range.

In one embodiment the control system limits the fuel flow to a gas turbine engine in accordance with a control signal received from the first detector should infra-red radiation from a turbine blade exceed a predetermined amount indicative of a rise in temperature of the blade, and the second detector is responsive to visible radiation received from hot carbonaceous matter passing through the engine to modify the control signal for the time of passage of said hot carbonaceous matter.

Embodiments of the invention will now be described, by way of example only, and with reference to the accompanying drawings in which.

Figure 1:
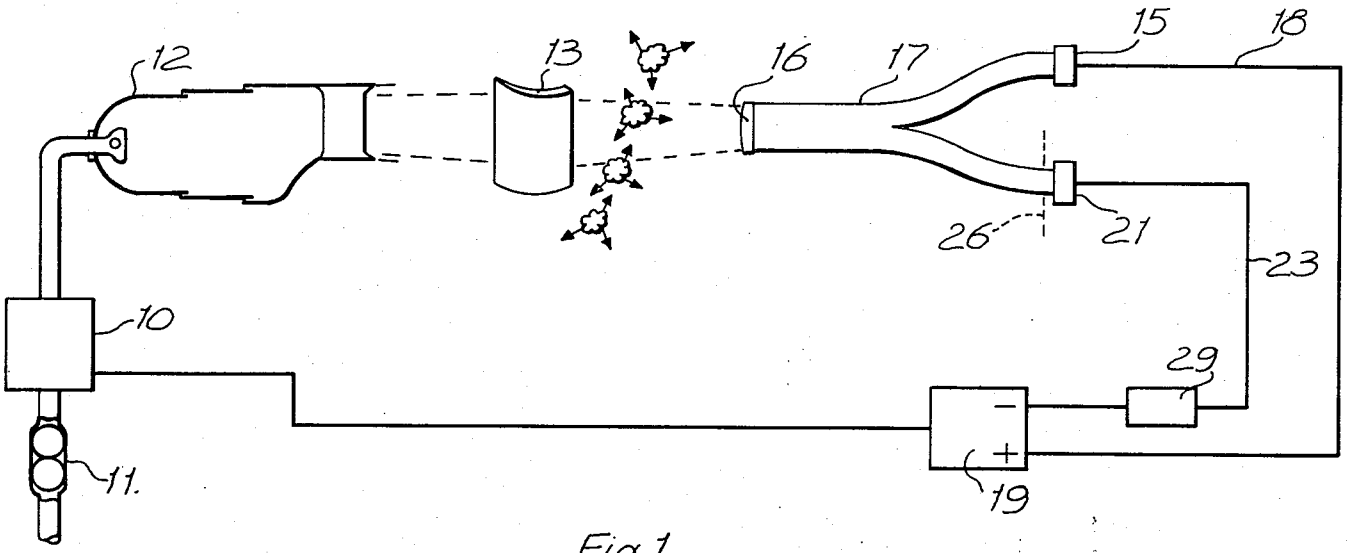
FIG. 1 is a schematic view of a control system.

Referring now to FIG. 1 there is shown a control system 10 which regulates the supply of fuel from a pump 11 to a gas turbine engine combustion chamber 12. In the combustion chamber 12 the fuel is mixed with air, the mixture is burned and the products of combustion drive turbine blades such as 13. As a result of this process the turbine blade temperature increases and they generate infra-red radiation corresponding to their instantaneous operating temperature. This radiation is received by a first detector 15 responsive to infra-red radiation via a sapphire lens 16 and a fibre-optic radiation guide 17. The infra-red radiation detector generates a control signal which is passed via line 18, and an operational amplifier 19, to the control system 10 where it acts as one control input which limits the fuel flow to the combustion chamber should the temperature of the turbine blade, as sensed by the quantity of infra-red radiation incident on the detector 15, exceed a predetermined level. The infra-red radiation detector thus far described is known and is not therefore described in detail.

An undesirable by-product of the combustion process is the generation of hot carbonaceous matter either in particulate form or as a diffuse cloud of hot particles.

This hot carbonaceous matter is particularly prevalent at high power settings of the engine and is at a much higher temperature than the turbine blades, typically 1900° K. as compared with 1150° K. The hot carbonaceous matter, as will be later explained with reference to FIG. 2, radiates considerable amounts of infra-red radiation and also visible radiation. The infra-red radiation is detected by the first detector in addition to the radiation from the turbine blades, and would give rise to an undesirable fuel limiting signal were it not for the presence of a second detector 21. The second detector 21 also receives radiation via the sapphire lens 16 and a second leg 22 of the fibre-optic radiation guide 17 but is responsive mainly to the visible light which is emitted predominantly by the hotter carbonaceous matter. In the event of the transient passage of hot carbonaceous matter past the field of view of sapphire lens 16, the second detector generates a second signal which is passed via the line 23 and the function generator 29 to the operational amplifier 19.

The function generator, which is an optional feature, modifies the output signal from the second detector, and the modified, or unmodified, second signal is used at the operational amplifier as hereinafter described, to modify the control signal from the first detector at least for the duration of the passage of carbonaceous material past the field of view of the sapphire lens.

Figure 2:
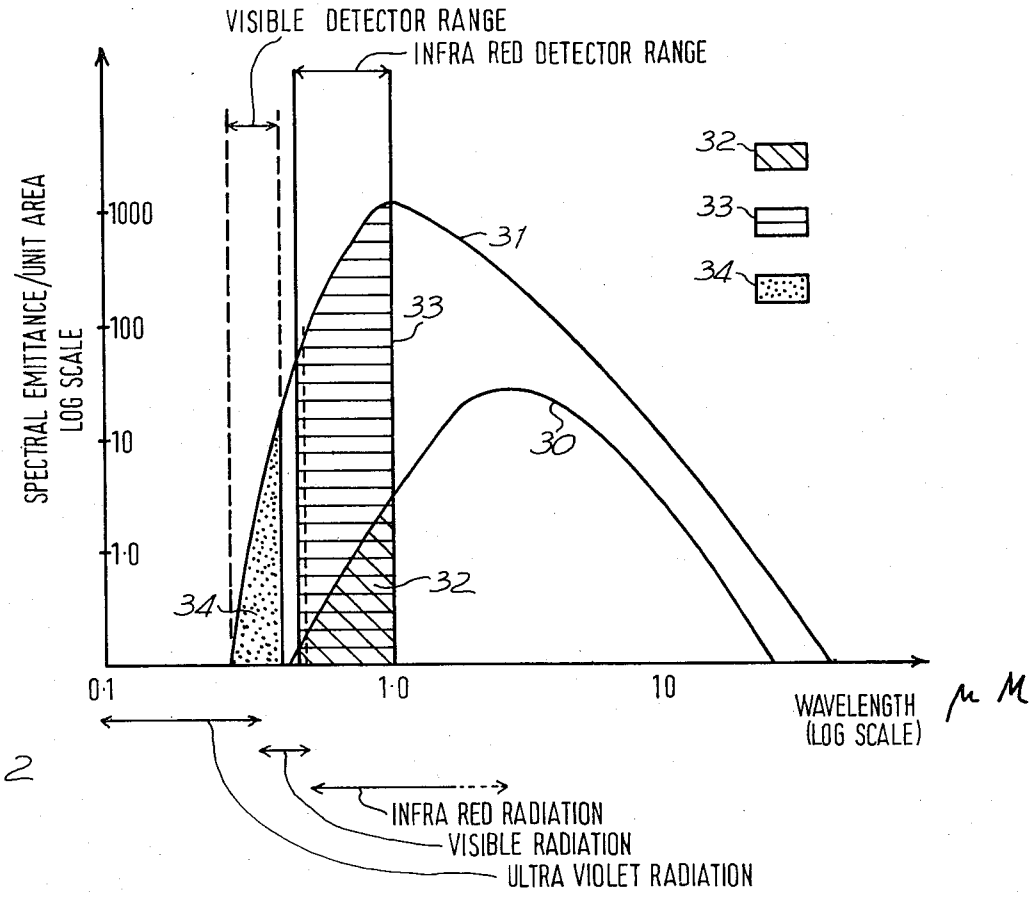
FIG. 2 is a graph illustrating the variation of spectral emittance with temperature.

Turning now to FIG. 2, there can be seen a graphical representation relating the spectral emittance from a black body, on a log scale, as abscissa, to the wavelength of radiation emitted, on a log scale, as ordinate.

To limit the range of wavelengths to which the second detector is responsive an optical filter 26 can be optionally placed in front of the detector 21, or alternatively the detector 21 comprises a semiconductor device appropriately adapted to bias its response characteristics to the visible light range.

On the graph are shown the relative spectral emittance curves for the turbine blades and the hot carbonaceous matter.

The curve 30 for the spectral emittance of the blades at 1150° K. lies predominantly biased towards the longer infra-red wavelengths whilst the spectral emittance of the hot carbonaceous material shown by the curve 31 is considerably greater and its peak is biased towards the visible wavelengths. The shaded area 32 under curve 30 represents the infra-red signal normally recorded by the first detector for the turbine blades and the overlying shaded area 33 is the additional infra-red signal generated by the transient passage of hot carbonaceous matter past the field of view of the sapphire lens 16.

Dotted area 34 under curve 31 represents the amount of visible light emitted by the hot carbonaceous matter and received by the second detector 21. The dotted area 34 is approximately proportional to the shaded area 33 over the range of temperature found for the hot carbonaceous matter.

The relationship between the amount of visible light and the amount of infra-red radiation emitted by the hot carbonaceous particles at any given temperature is the subject of well-known physical laws. The function generator 29 is a device for making the mathematical conversion necessary and its electronic components form an appropriate combination of basic simple known circuits within the skill and knowledge of the electronic engineer and are not described in detail in this specification.

The function generator which receives an output signal from the second detector proportional to the dotted area 34, changes the size of this output signal into an amount equivalent to the additional infra-red signal generated by hot carbonaceous matter, i.e. the shaded area 33, and this is then subtracted at the operational amplifier 19 from the signal received from the first infra-red detector which is proportional to the sum of the areas 33 and 34. Thus the control system receives a signal proportional only to the turbine blade temperature and is therefore unaffected by the transient passage of hot carbonaceous matter through the engine. It will be appreciated that instead of the use of a function generator, logic circuitry may be used, the effect of which is to check to see if the signal received by the second detector is above a certain threshold and if so, to instruct the amplifier to read the signal it previously saw for the duration of the second signal from the second detector.

It will be further appreciated that whilst the embodiment above is described in relation to a gas turbine engine, similar embodiments can be used in other circumstances. For example, the flow of opaque chemicals through processing plant can be observed by the attenuation of visible radiation from a transmitter and a second detector can be utilised to use any additional signal arising from the periodic throughflow of quantities of fluorescent die to modify the first signal. Alternatively, the passage of articles through a heat treatment furnace can be controlled and periodic incandescense ignored.

I claim:

1. A fuel control system for a gas turbine engine comprising:

first and second radiation detectors positioned to monitor radiation emanating from combustion equipment of the engine, the first detector being responsive to radiation in the infra-red frequency range to produce a first signal representative of the radiation in the infra-red frequency range, the second detector being responsive to radiation in the visible frequency range produced by a transient radiation event which also produces radiation in the infra-red frequency range to produce a second signal representative of the radiation in the visible frequency range, a function generator operative to receive the second signal and derive therefrom a third signal indicative of the radiation in the infra-red frequency range corresponding to the detected radiation in the visible frequency range, a comparator means for comparing the first and third signals and operative to produce a fourth signal, and control means responsive to said fourth signal for regulating the fuel supplied to the combustion equipment of the engine.

2. A control system according to claim 1, wherein at least the first detector monitors the temperature of a turbine blade of the engine and said control means is responsive to the fourth signal to limit the supply of fuel to the combustion apparatus of the engine in dependence upon the temperature of the turbine blade exceeding a predetermined temperature.

3. A control system according to claim 2 and in which the second detector is responsive to the visible light produced by the passage of hot carbonaceous matter past the turbine blade to produce said second signal, the means responsive to generation of the second signal causing any corresponding increase in the signal from the first detector to be nullified before it affects the control means at least for the duration of the passage of said carbonaceous material.

* * * * *